US006840326B2

(12) United States Patent
Shiyou

(10) Patent No.: US 6,840,326 B2
(45) Date of Patent: Jan. 11, 2005

(54) LIFTING APPARATUS AND METHOD FOR OIL FIELD RELATED SERVICES

(75) Inventor: Al Joseph Shiyou, Kiln, MS (US)

(73) Assignee: Fastorq LLC, Harvey, LA (US)

( * ) Notice: Subject to any disclaimer, the term of this patent is extended or adjusted under 35 U.S.C. 154(b) by 141 days.

(21) Appl. No.: 10/238,189

(22) Filed: Sep. 10, 2002

(65) Prior Publication Data

US 2004/0045721 A1 Mar. 11, 2004

(51) Int. Cl.[7] ..... E21B 33/072; B66D 1/26

(52) U.S. Cl. ..... 166/385; 166/85.4; 254/285; 254/286; 254/385

(58) Field of Search ..... 166/385, 85.4, 166/77.1; 175/85, 170; 254/285, 286, 385, 386

(56) References Cited

U.S. PATENT DOCUMENTS 2,984,455 A * 5/1961 Fischer ..... 254/274
3,716,993 A * 2/1973 Sumner ..... 405/198
3,838,836 A * 10/1974 Asseo et al. ..... 244/137.4
4,003,435 A * 1/1977 Cullen et al. ..... 166/385
4,305,467 A 12/1981 Villines ..... 166/385
5,467,833 A * 11/1995 Crain ..... 175/52
5,509,639 A * 4/1996 Ellis ..... 254/380
5,662,434 A * 9/1997 Khachaturian ..... 405/204
5,816,565 A 10/1998 McGuffin ..... 254/386
5,957,431 A * 9/1999 Serda, Jr. ..... 254/285
6,053,255 A 4/2000 Crain ..... 168/385
6,318,931 B1 * 11/2001 Khachaturian ..... 405/204

* cited by examiner

*Primary Examiner*—David Bagnell
*Assistant Examiner*—Shane Bomar
(74) *Attorney, Agent, or Firm*—Baker Botts L.L.P.

(57) ABSTRACT

Apparatus and method are provided for lifting heavy loads beneath the floor of a drilling rig or a platform. A base skid supports tables to which winch bases are attached. Winches, usually four in number, are placed on the winch bases and the cables of the winches are placed through sheaves and attached to a double line bar. Sheaves are attached to a load, such as a blowout preventer. Cradle lines may support a blowout preventer. Load cells may be used with the winch cables.

19 Claims, 7 Drawing Sheets

LIFTING APPARATUS AND METHOD FOR OIL FIELD RELATED SERVICES

BACKGROUND OF THE INVENTION

1. Field of the Invention

This invention relates to drilling and servicing of wells. More particularly, improved apparatus and method for lifting blowout preventers or other heavy loads below the floor of a drilling rig or the main deck of a platform are provided.

2. Description of Related Art

Blowout preventers (BOPS) are used on drilling rigs to prevent continued influx of subsurface fluids into a drilling well, displacing the drilling fluid from the wellbore. As drilling fluid is displaced from the well at the surface of the earth, the hydrostatic pressure available to control influx of subsurface fluids is decreased, allowing influx of subsurface fluids at an even higher rate. If subsurface fluids flow to the surface of the earth, a "blowout" has occurred. Such occurrences are normally avoided by closing one or more of the BOPs in a BOP "stack" upon detection of significant flow of drilling fluid at the surface of a wellbore and then taking other steps to control influx of subsurface fluid.

The BOP stack is attached to the top of a casing that is cemented in the wellbore and the stack normally extends vertically to a few feet below the drilling rig floor. During the drilling process, it is often necessary to lift the BOP off the casing—to set casing slips or drilling spools, for wellhead change-outs or for other purposes. In recent years, with deeper and higher pressure wells being drilled, the weight of BOP stacks has continued to increase. At present, stacks may be used that weigh over 80 tons. Other needs may arise for lifting loads of more than 100 tons below the floor of a drilling rig or the main deck of a platform such as for salvage or recovery of equipment.

A compact winch unit placed on the drilling rig floor to lift blowout preventers is disclosed in U.S. Pat. No. 4,305,467. This patent describes the placement of two winches on a base frame, positioning the base frame on the rotary table and lifting blowout preventers by the winches. U.S. Pat. No. 5,816,565 discloses a lifting apparatus for blowout preventers in which a sliding sheave assembly is mounted to a frame assembly. The sliding sheave assembly has a first shaft with a plurality of sheaves mounted on it and a second sheave with a plurality of sheaves mounted on the second shaft. A heavy object such as a BOP stack is lifted by extending the rod end of a cylinder to increase the distance between the first and second sheaves. U.S. Pat. No. 6,053,255 discloses multiplying the safety factor of wire rope used on winch apparatus in lifting blowout preventers by employing multiple segments of cable on each of the drums of the winch units.

There is a continuing need to lift such heavy loads with equipment that can be easily mobilized and de-mobilized in the confined space of a drilling rig floor or platform and that has lifting capacity to provide a satisfactory safety factor while lifting the heaviest of BOP stacks.

SUMMARY OF THE INVENTION

Apparatus and method are disclosed for increasing the lifting capacity of apparatus used for lifting blowout preventers below the floor of a drilling rig by employing four simultaneously operated winches to perform the lifting operation. The winches are supported in two levels by a frame that is adapted for easy transport and installation on a drilling rig. The winches are controlled at a single or dual operating point.

DETAILED DESCRIPTION OF THE INVENTION

Figure 1:
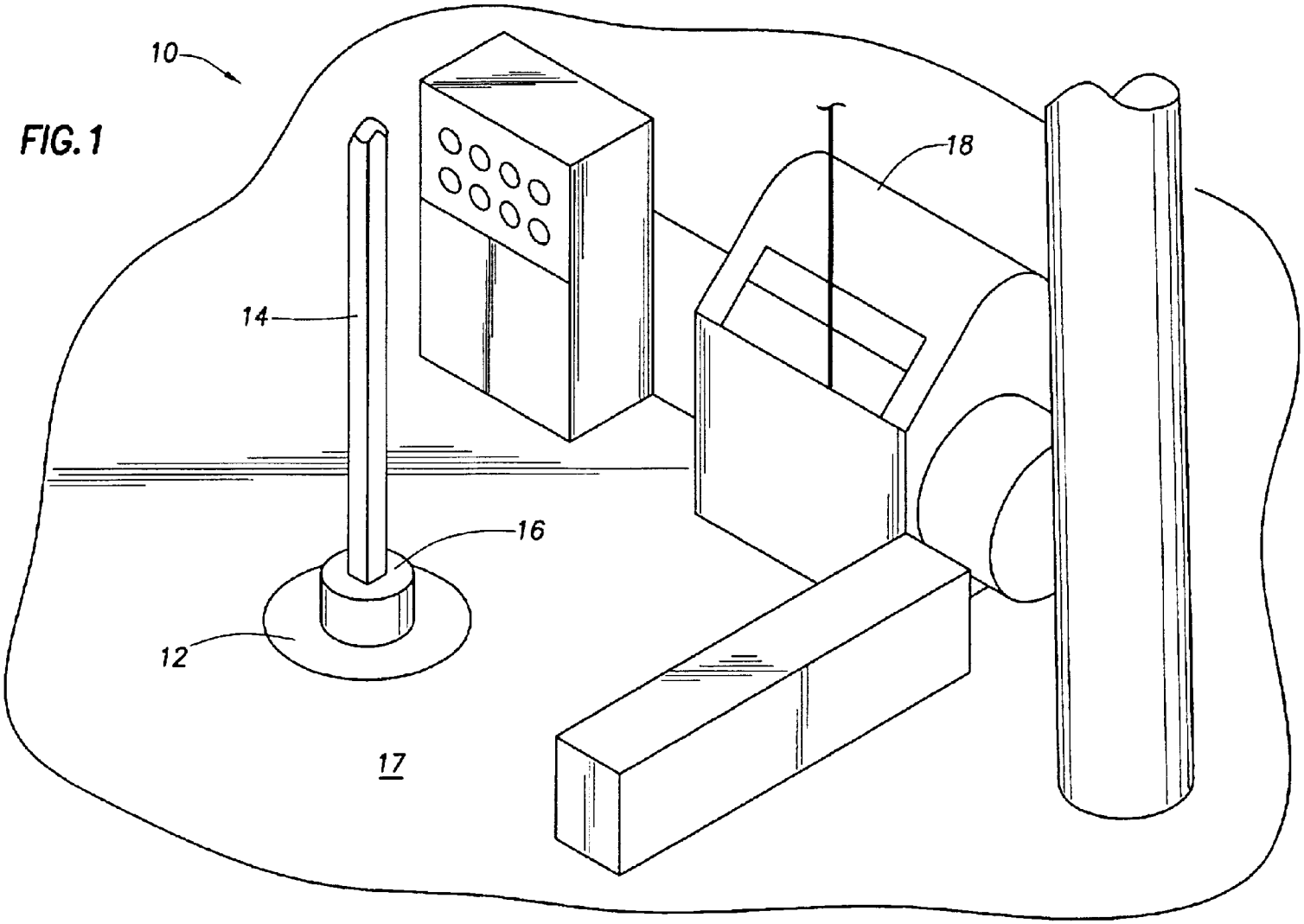
FIG. 1 is an elevation view of the floor of a drilling rig before installation of apparatus disclosed herein.

Referring to FIG. 1, a view of a floor of a typical drilling rig is shown. Rotary table 12 is turned by a drive mechanism (not shown) below rig floor 17. Kelly joint 14 passes through master bushing 16 and is connected to drill pipe in the hole being drilled. Drilling line or cable passing over sheaves in a mast (not shown) is operated by a winch in draw works 18 and is used for supporting the drill string and lowering it as hole is drilled. The drill string passes through a blowout preventer stack (not shown) that is beneath rotary table 12.

Figure 2:
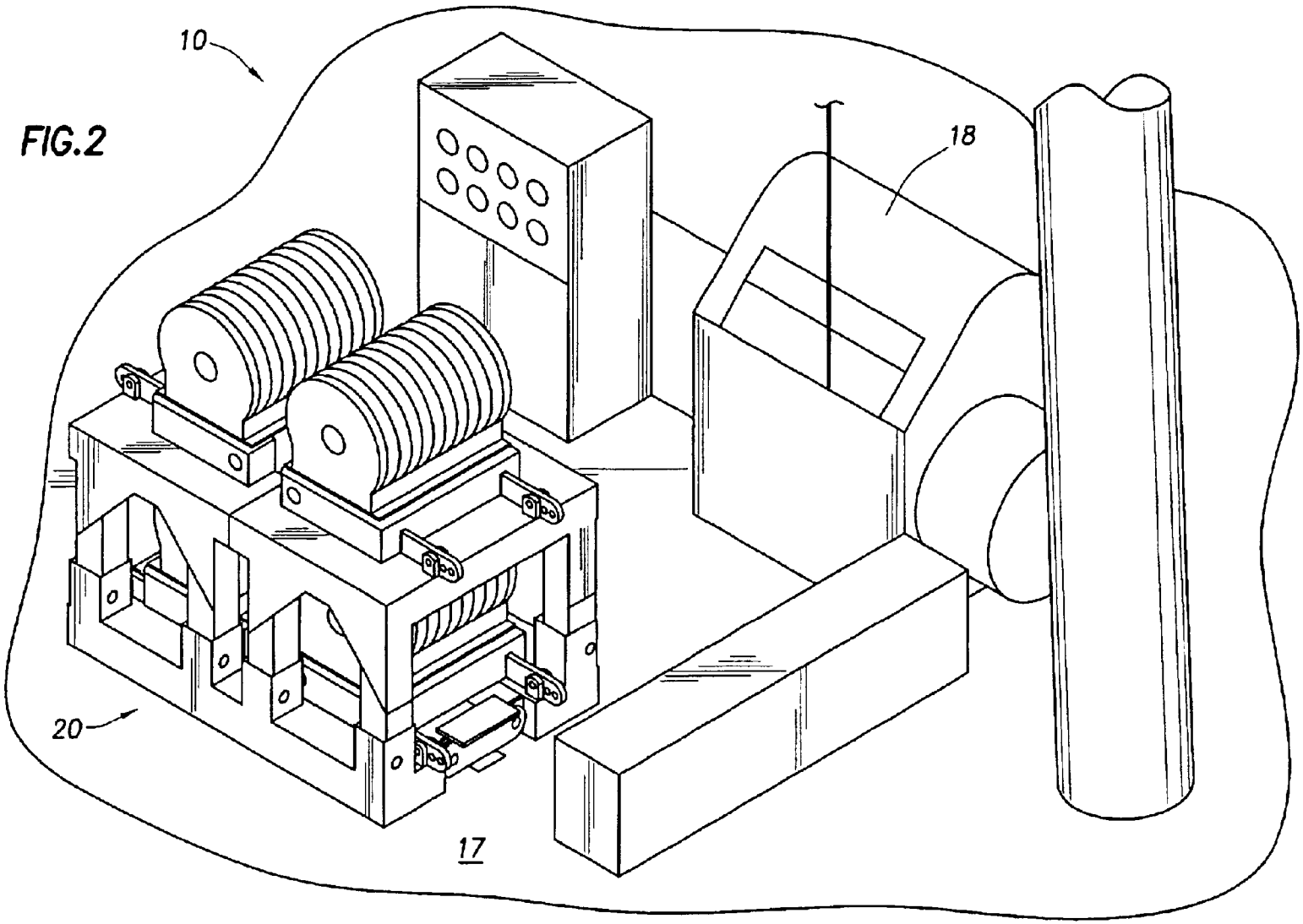
FIG. 2 is an elevation view of apparatus disclosed herein deployed on the floor of a drilling rig.

When a blowout preventer or other heavy equipment is to be lifted under the drilling floor, kelly joint 14 and the connected drill string are removed from the well. Master bushing 16 can then be removed, leaving a flat surface of rotary table 12 at about the level of rig floor 17. Horizontal room on the floor is limited by equipment such as shown in FIG. 1. Referring to FIG. 2, lift system 20, disclosed herein, can then be placed over the rotary table and on rig floor 17.

Figure 3:
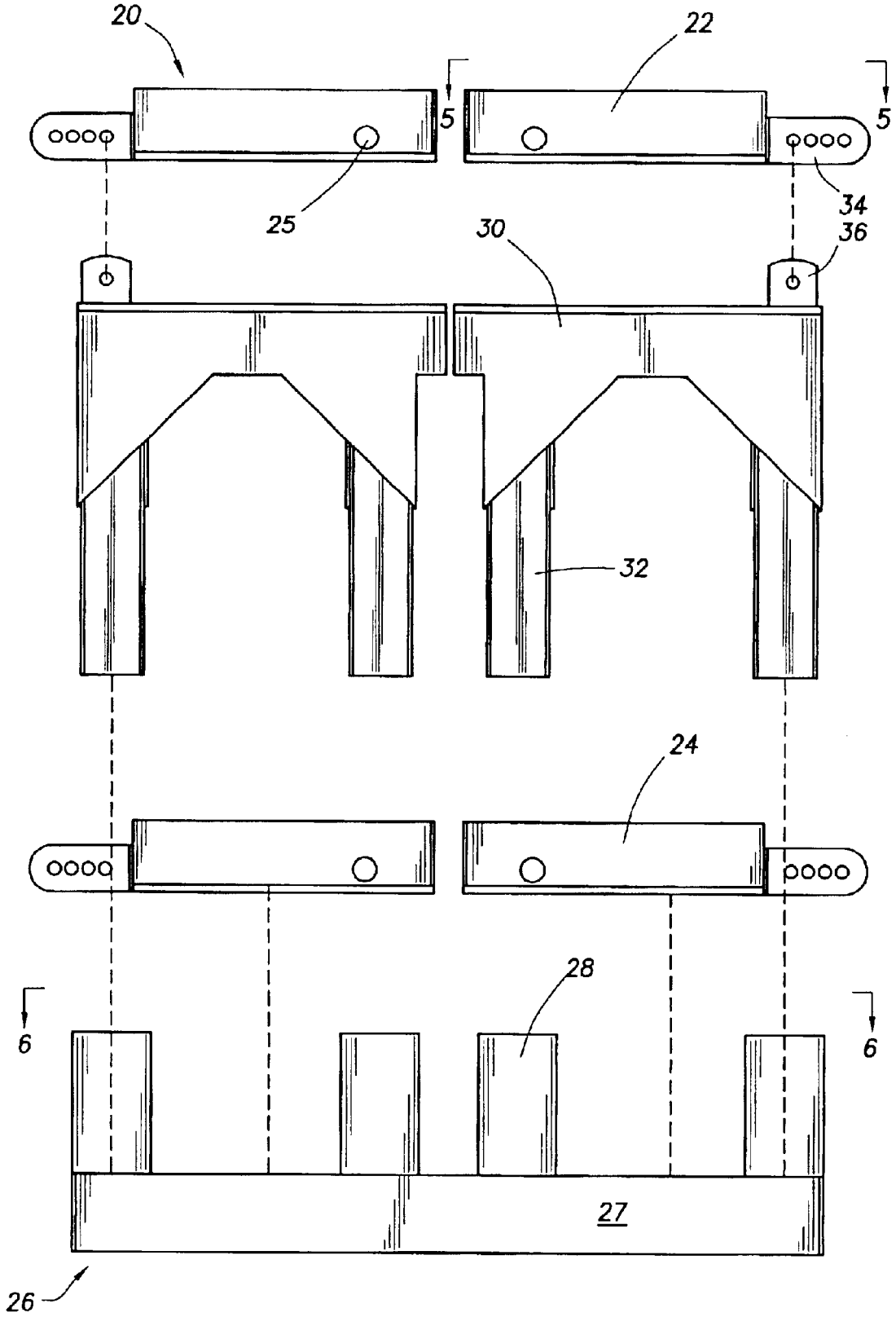
FIG. 3 shows an elevation view during assembly of the support apparatus disclosed herein.
Figure 4:
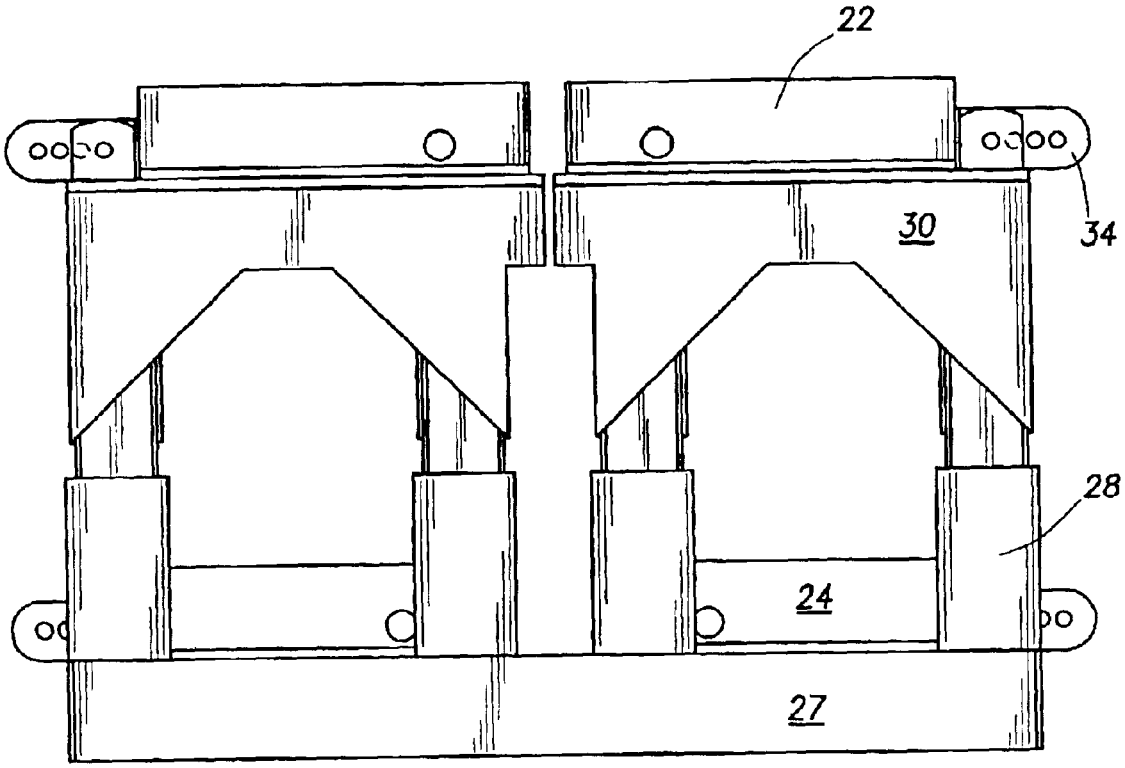
FIG. 4 shows an elevation view of assembled support apparatus disclosed herein.
Figure 5:
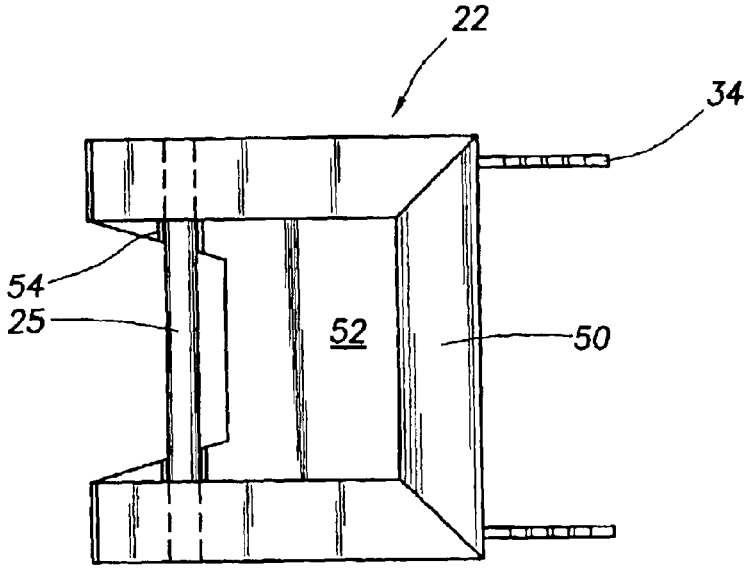
FIG. 5 shows a top view of a base plate for a winch.
Figure 6:
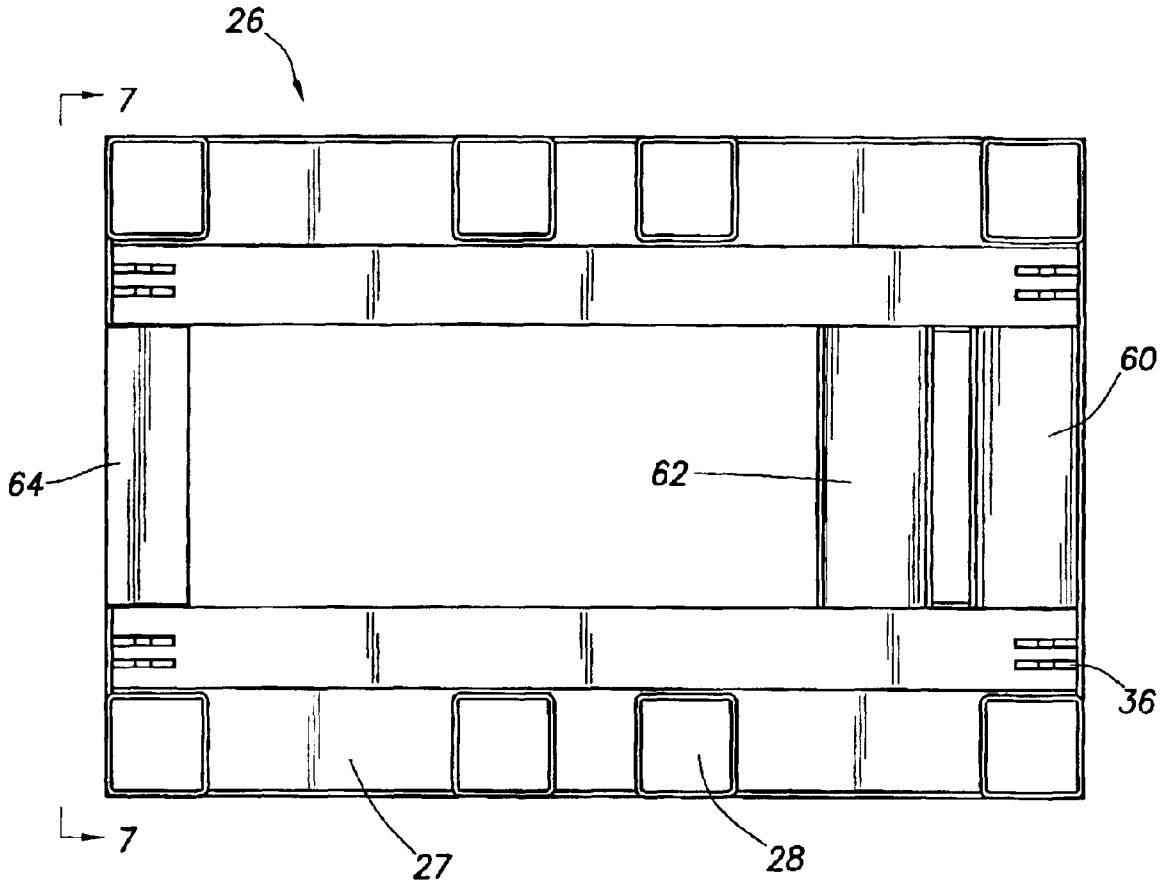
FIG. 6 shows a top view of a bottom skid.

Referring to FIG. 3, a support structure used in lift system 20 is shown. Top winch base 22 and bottom winch base 24 each is designed to support a winch (not shown). Each winch base includes double line bar 25. Base skid 26 includes frame 27 and sockets 28. Table top 30 is supported by table legs 32, which are sized for insertion into sockets 28. The position of each winch base can be adjusted by connecting connector arm 34 to padeyes 36 through a pin in a selected hole in arm 34. Cross-sections 5—5 and 6—6, indicated in FIG. 3, are shown in FIGS. 5 and 6. FIG. 4 shows the parts identified in FIG. 3 after assembly, but without winches.

FIG. 5 shows a top view of winch base 22 or 24. Frame 50 may be welded construction formed from box tubing, which may have a wall thickness of 0.5 inch and be 8-inches square. Base plate 52 may be sheet steel 1-inch thick. Double line bar 25 is preferably formed of solid high-strength 4140 grade steel with a diameter in the range to 3 to 4 inches. Gusset plate 54 may be used to reinforce frame 50 around the ends of bar 25, and may have a thickness of about 0.5 inch.

Figure 7:
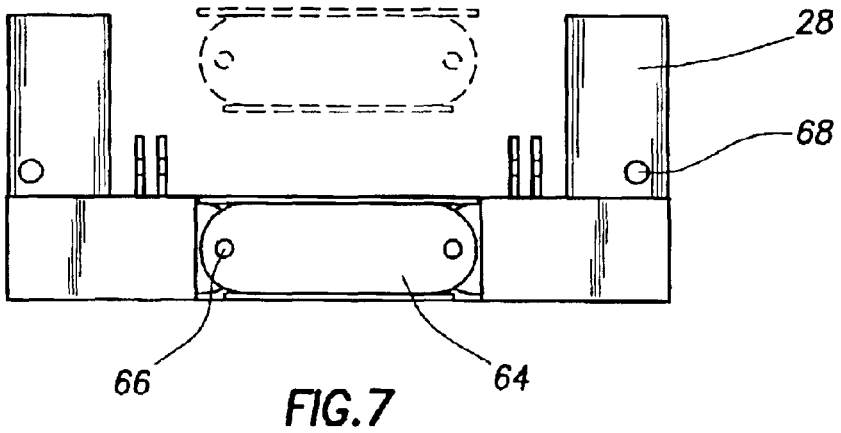
FIG. 7 shows an end view of the bottom skid.

FIG. 6 shows section 6—6 of base skid 26, as indicated in FIG. 3. Lateral frame member 27 may be constructed of box tubing having a wall thickness of 0.5 inch and dimensions of 8-inches square, with two pieces joined to form lateral frame member 27. Fixed end frame member 60 and support member 62 may be formed of the same material. Removable support member 64, also of the same material, may be removed to allow base skid 26 to be placed around any protrusion from rotary table 12 (FIG. 1) when placing system 20 on a rig floor. FIG. 7, illustrating section 7—7 of FIG. 6, shows that removable support member 64 may be held in place by pins 66. Sockets 28 may include holes 68 that can be used to pin legs 32 in place when system 20 is installed.

Figure 8:
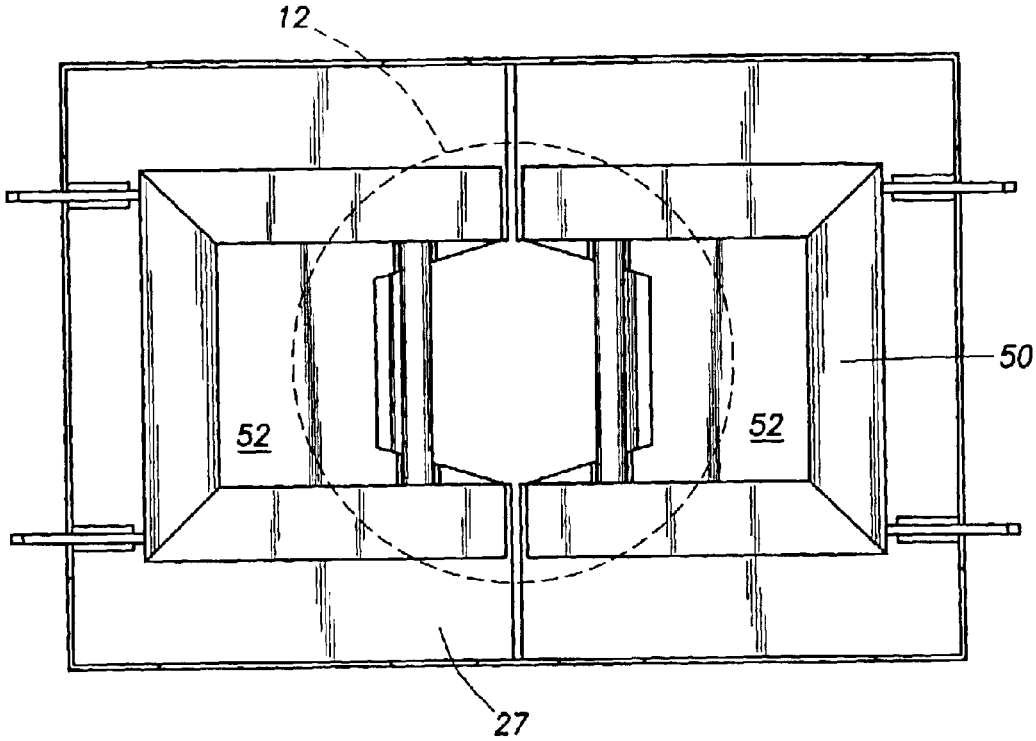
FIG. 8 shows a top view of the assembled apparatus.

FIG. 8 is a top view of the apparatus shown in FIG. 4, which shows top winch base 22 (FIG. 4), including frame 50 and base plate 52. The opening between plates 52 is sized to allow cable from winches that are placed on the winch bases to pass through without touching a base plate. Rotary table 12 is indicated under the apparatus.

Figure 9:
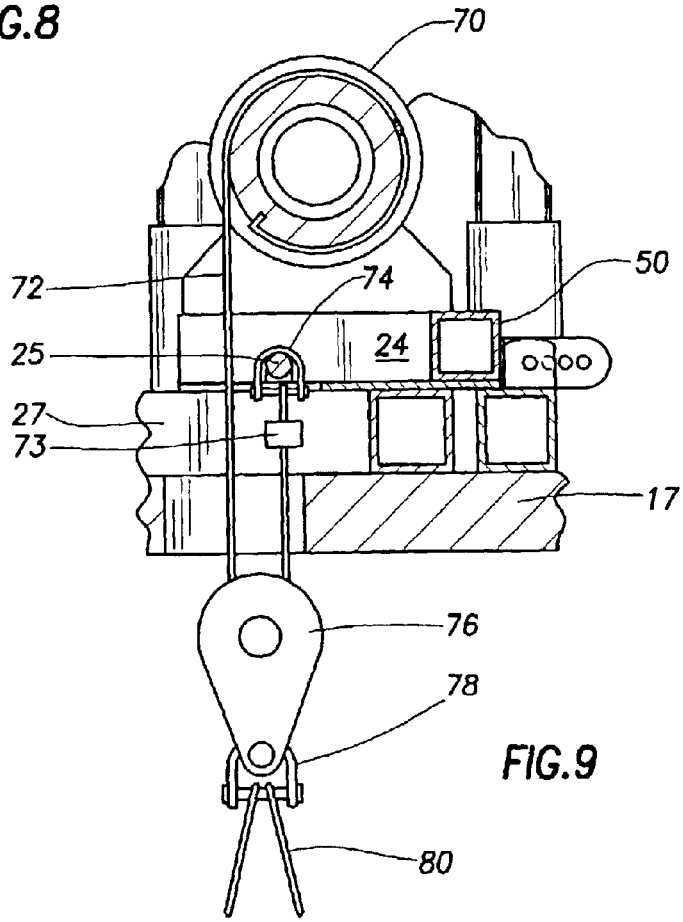
FIG. 9 shows an end view of a cross-section of a winch on the bottom skid.

FIG. 9 shows a cross-sectional end view of winch 70 mounted on lower base plate 24, frame 27 and rig floor 17. Double-line capacity of winch 70 is obtained by passing winch cable 72 through sheave 76 and attaching the end of winch cable 72 to cross-bar 25. Shackle 74 may conveniently be used for fixing the end of cable 72. Preferably, shackle 74 is placed near an end of cross-bar 25, to minimize bending stress on the cross-bar. Cradle cable 80 may be attached to sheave 76 by shackle 78. Load cell 73, which may have a remote readout, as is well known in the art, may be placed in winch cable 72 to measure the load at any time.

Figure 10:
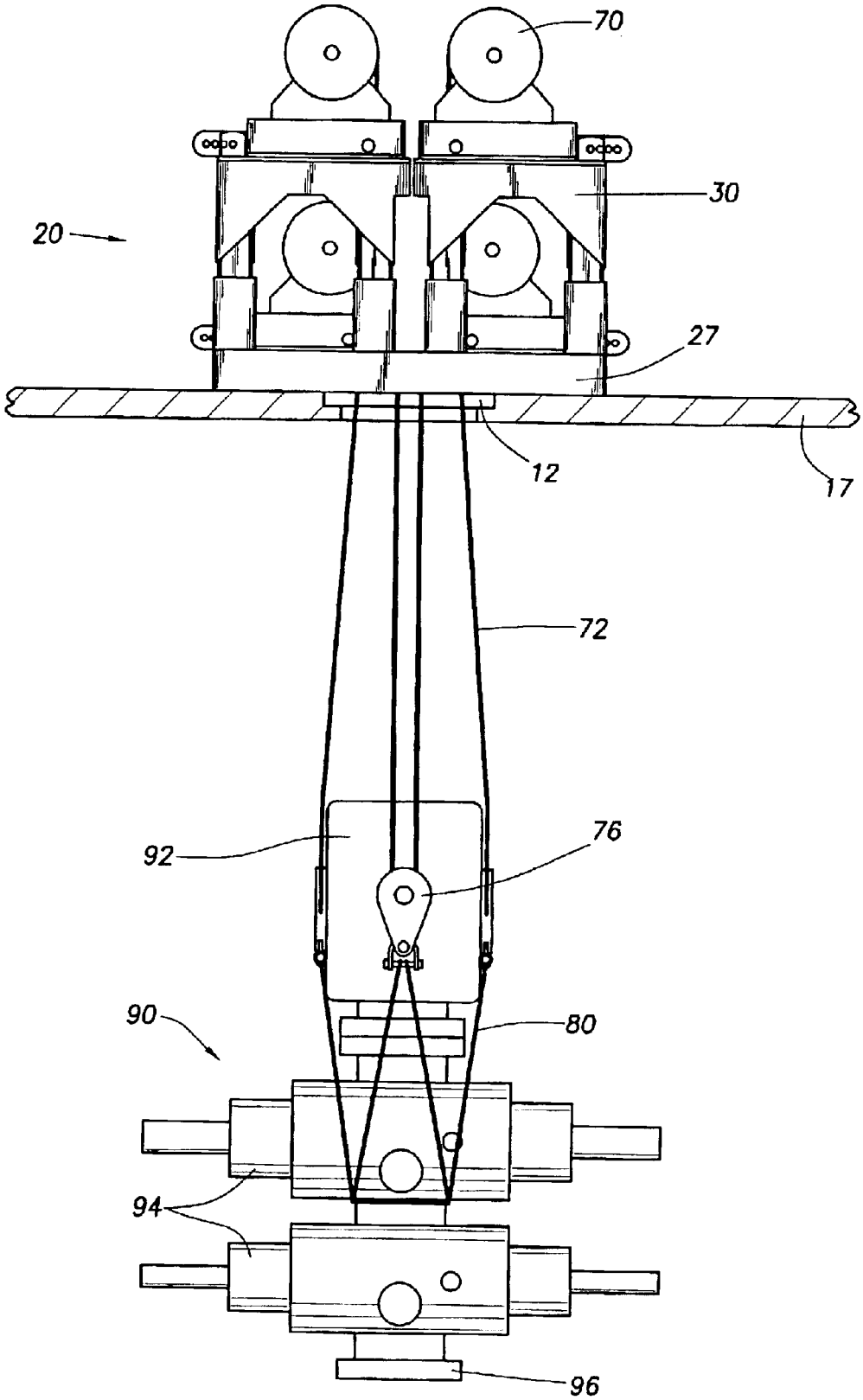
FIG. 10 shows an elevation view of the apparatus disclosed herein lifting a blowout preventer.

FIG. 10 shows all four winches of apparatus 20 disclosed herein mounted on table tops 30, base plate 27 and rig floor 17. Rotary table 12 provides an opening through rig floor 17. A belly pan (not shown) may be present under rotary table 12. The opening in a belly pan may be increased if necessary to provide room for cables 72 to pass through relative to various rig configurations. Winch cables 72 then provide eight lines to sheaves 76 and thus, through cradle cables 80, to blowout preventer stack 90, which includes annular preventer 92, ram preventers 94 and flange 96. The diameter of winch cables 72 may be about 1.25 inches. The diameter of cradle cables may be about 1.25 inches. Blowout preventer stack 90 may weigh more than 80 tons. It is important that cables from the winches pass through the drilling rig floor without contacting any part of the rotary table. When it is lifted, personnel may perform mechanical tasks under stack 90. It is important to achieve high safety factors for lifting under such conditions.

Apparatus disclosed herein may be assembled and employed as follows. Referring to FIG. 3, unassembled base skid 27 is shown. Base skid 27 is first positioned over rotary table 12 (FIG. 1) of the rig. Hydraulic hoses are pulled up to rig floor 17 so as to reach the winches. Hydraulic hoses are connected to the winches and to a manifold on the power unit supplying hydraulic power. A remote control unit for the winches is brought to the rig floor. Winch lines are then lowered to the "Texas deck" of an offshore platform if the apparatus is used offshore. Sheaves are then placed on the Texas deck of the platform. Winch lines are placed on a winch to avoid more than one layer of line on a drum.

In one embodiment, winch lines 72 (FIG. 9) are run through sheaves 76 and sheave shackle 78 and pins are then placed back on the sheave. An air hoist is placed near the end of winch line 72 and the air hoist is used to pull the winch line through the rotary table until the sheave hangs free and the end of the winch line is at the connecting position of double line bar 25. Shackle 74 is placed over the double line bar and connected to the dead end of winch line 72. These steps are then repeated until the all sheaves and winch lines are connected. Sheaves are then lowered to the top ram of the blowout preventer stack.

In an alternate procedure, after winches 70 are set in place on the rotary floor the sheaves are placed on the rotary floor, pins and shackles are removed, and one winch is unspooled with enough slack to pass through the sheave. The sheave is then picked up with an air hoist attached to a pad eye on the sheave. The sheave is moved towards the rotary, pulling the winch lines to remove slack. A second air hoist is tied to the dead end of the winch line and the sheave is lowered through the rotary with the dead man side on the button end of the drum, or where the cable ties into the drum. The sheave is lowered just past the double line bar and the dead end is attached to the double line bar, placing a shackle over the bar. A shackle pin is then placed through the eye of the socket on the dead end of the winch line. A second air hoist is slacked off and disconnected. The first air hoist is then disconnected from the sheave and the sheave is lowered down to the BOPS for connection.

Four slings are to be used on a BOP. The top winches of FIG. 10 are connected first. Slings are bridled around the BOP and lifting cables are attached under the top ram of the BOP.

While lifting, each lifting line should maintain an equal and consistent tension. If this is not done, the bolts on the flange of the BOP will be difficult to remove.

The BOP is then nippled down preparatory to lifting. The winch operator must pick up on one side while watching the bell nipple attached to the BOP. Lifting is performed such that the bell nipple remains centered and the weight distribution is equalized. Lifting is continued on the BOP winches for two or three inches and stopped. All winch lines are checked to insure that lifting is straight and all slings, sheaves and winch lines are clear. Lifting will continue 3 or 4 inches until the desired separation and clearance is achieved. Lowering of the BOP is performed in a conventional manner.

While particular embodiments of the present invention have been described, it is not intended that these details should be regarded as limitations on the present invention, except as to the extent that they are included in the appended claims. It should be understood that various changes, substitutions and alterations can be made hereto without departing from the spirit and scope of the invention as defined by the appended claims.

I claim:

1. An apparatus for lifting beneath the floor of a drilling rig or a platform, comprising:

a base skid, the base skid having a plurality of sockets;

a plurality of table tops, each table top having table legs adapted for placement in the sockets of the base skid;

a plurality of winch bases, each winch base having a double line bar and an attachment to the base skid or the table tops; and a plurality of winches adapted for placement on the winch bases, each winch having a winch cable, the winch cable being attached to the double line bar.

2. The apparatus of claim 1 wherein the number of the plurality of winches is four.

3. The apparatus of claim 1 wherein the attachment of the winch bases to the base skid and the table tops is a connector arm having a plurality of holes adapted for pinning the connector arm to the table tops or the base skid.

4. The apparatus of claim 1 wherein the base skid comprises a removable support member.

5. The apparatus of claim 1 further comprising a gusset plate disposed in proximity to the double line bar of the winch base.

6. The apparatus of claim 1 further comprising a load cell adapted for measuring load of the winch cable.

7. An apparatus for lifting a blowout preventer stack beneath the floor of a drilling rig, comprising:

a base skid, the base skid having a plurality of sockets;

a pair of table tops, each table top having table legs adapted for placement in the sockets of the base skid;

two pair of winch bases, each winch base having a double line bar and an attachment to the base skid or the table tops;

two pairs of winches adapted for placement on the winch bases, each winch having a winch cable, the winch cable having a selected load capacity and being connected to the double line bar of the winch base; and two pairs of sheaves disposed between the winch cables and being connected to a plurality of cradle cables.

8. The apparatus of claim 7 wherein the attachment of the winch bases to the base skid and the table tops is a connector arm having a plurality of holes adapted for pinning the connector arm to the table tops or the base skid.

9. The apparatus of claim 7 wherein the base skid comprises a removable support member.

10. The apparatus of claim 7 further comprising a gusset plate disposed in proximity to the double line bar.

11. The apparatus of claim 7 further comprising a load cell in the winch cable.

12. A method for lifting a load below a floor of a drilling rig or a platform, comprising:

placing a base skid over the load;

placing a plurality of table tops and winch bases on the base skid;

placing a plurality of winches on the winch bases, each winch having a winch line;

placing the winch line of each winch in a sheave and connecting the winch line to a double line bar in the winch base;

connecting the sheave to the load; and operating the winches.

13. The method of claim 12 further comprising attaching the winch bases to the table tops or the base skid through a connector arm.

14. The method of claim 12 wherein the step of placing the base skid over the load includes the step of removing a removable support member of the base skid.

15. The method of claim 12 further comprising the step of placing a load cell in the winch line of at least one winch.

16. A method for lifting a blowout preventer below a floor of a drilling rig, comprising:

placing a base skid on the floor over the blowout preventer;

placing two pairs of table tops and two pairs of winch bases on the base skid;

placing two pairs of winches on the winch bases, each winch having a winch line;

placing the winch line of each winch in a sheave and connecting the winch line to a double line bar in the winch base;

connecting the sheave to a plurality of cradle cables; and placing the cradle cables so as to support the blowout preventer; and operating the winches.

17. The method of claim 16 further comprising attaching the winch bases to the table tops or the base skid through a connector arm.

18. The method of claim 16 wherein the step of placing the base skid over the load includes the step of removing a removable support member of the base skid.

19. The method of claim 16 further comprising the step of placing a load cell in the winch line of at least one winch.

* * * * *